US005634643A

United States Patent [19]

McEvoy

[11] Patent Number: 5,634,643

[45] Date of Patent: Jun. 3, 1997

[54] SOCK BALL GAME SYSTEM

[76] Inventor: Terrence V. McEvoy, 5206 33rd Ave. South, Minneapolis, Minn. 55417-2039

[21] Appl. No.: 648,383

[22] Filed: May 15, 1996

[51] Int. Cl.[6] ..... A63B 65/12

[52] U.S. Cl. ..... 473/423; 473/575

[58] Field of Search ..... 273/414, 29 A, 273/413, 58 R, 58 C, 58 K

[56] References Cited

U.S. PATENT DOCUMENTS

| | | | |
|---|---|---|---|
| D. 254,318 | 2/1980 | Kupperman et al. | D21/91 |
| 2,140,411 | 12/1938 | Wood | 273/413 |
| 4,034,981 | 7/1977 | Veneziano | 273/29 A |
| 4,240,629 | 12/1980 | Song et al. | 273/58 C |
| 4,295,647 | 10/1981 | Daly | 273/440 |
| 4,453,072 | 6/1984 | Middleton, Jr. et al. | 219/86.23 |
| 5,348,293 | 9/1994 | Smith | 273/29 A |

*Primary Examiner*—William H. Grieb

[57] ABSTRACT

A new Sock Ball Game System for decreasing the velocity and increasing the visibility of a ball during play and for preventing the ball from rolling away after engaging the ground. The inventive device includes a ball such as a tennis ball, and an elongated sock enclosure surrounding the ball and trailing behind the ball during play.

2 Claims, 2 Drawing Sheets

SOCK BALL GAME SYSTEM

BACKGROUND OF THE INVENTION

1. Field of the Invention

The present invention relates to Ball Devices and more particularly pertains to a new Sock Ball Game System for decreasing the velocity and increasing the visibility of a ball during play and for preventing the ball from rolling away after engaging the ground.

2. Description of the Prior Art

The use of Ball Devices is known in the prior art. More specifically, Ball Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Ball Devices include U.S. Pat. Nos. 4,034,981 ; 4,453,072; 5,348,293; 4,240,629; U.S. Design Pat. No. 254,318 and U.S. Pat. No. 4,295,647.

While these devices fulfill their respective, particular objectives and requirements, the aforementioned patents do not disclose a new Sock Ball Game System. The inventive device includes a ball such as a tennis ball, and an elongated sock enclosure surrounding the ball and trailing behind the ball during play.

In these respects, the Sock Ball Game System according to the present invention substantially departs from the conventional concepts and designs of the prior art, and in so doing provides an apparatus primarily developed for the purpose of decreasing the velocity and increasing the visibility of a ball during play and for preventing the ball from rolling away after engaging the ground.

SUMMARY OF THE INVENTION

In view of the foregoing disadvantages inherent in the known types of Ball Devices now present in the prior art, the present invention provides a new Sock Ball Game System construction wherein the same can be utilized for decreasing the velocity and increasing the visibility of a ball during play and for preventing the ball from rolling away after engaging the ground.

The general purpose of the present invention, which will be described subsequently in greater detail, is to provide a new Sock Ball Game System apparatus and method which has many of the advantages of the Ball Devices mentioned heretofore and many novel features that result in a new Sock Ball Game System which is not anticipated, rendered obvious, suggested, or even implied by any of the prior art Ball Devices, either alone or in any combination thereof.

To attain this, the present invention generally comprises a ball such as a tennis ball, and an elongated sock enclosure surrounding the ball and trailing behind the ball during play.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Sock Ball Game System apparatus and method which has many of the advantages of the Ball Devices mentioned heretofore and many novel features that result in a new Sock Ball Game System which is not anticipated, rendered obvious, suggested, or even implied by any of the prior art Ball Devices, either alone or in any combination thereof.

It is another object of the present invention to provide a new Sock Ball Game System which may be easily and efficiently manufactured and marketed.

It is a further object of the present invention to provide a new Sock Ball Game System which is of a durable and reliable construction.

An even further object of the present invention is to provide a new Sock Ball Game System which is susceptible of a low cost of manufacture with regard to both materials and labor, and which accordingly is then susceptible of low prices of sale to the consuming public, thereby making such Sock Ball Game System economically available to the buying public.

Still yet another object of the present invention is to provide a new Sock Ball Game System which provides in the apparatuses and methods of the prior art some of the advantages thereof, while simultaneously overcoming some of the disadvantages normally associated therewith.

Still another object of the present invention is to provide a new Sock Ball Game System for decreasing the velocity and increasing the visibility of a ball during play and for preventing the ball from rolling away after engaging the ground.

Yet another object of the present invention is to provide a new Sock Ball Game System which includes a ball such as a tennis ball, and an elongated sock enclosure surrounding the ball and trailing behind the ball during play.

Even still another object of the present invention is to provide a new Sock Ball Game System that prevents the ball from rolling away from the user during play.

Still another object of the present invention is to increase the visibility of a ball during play.

Even still another object of the present invention is to increasing the learning of a beginner at a game such as tennis by allowing the beginner to follow the ball easier.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
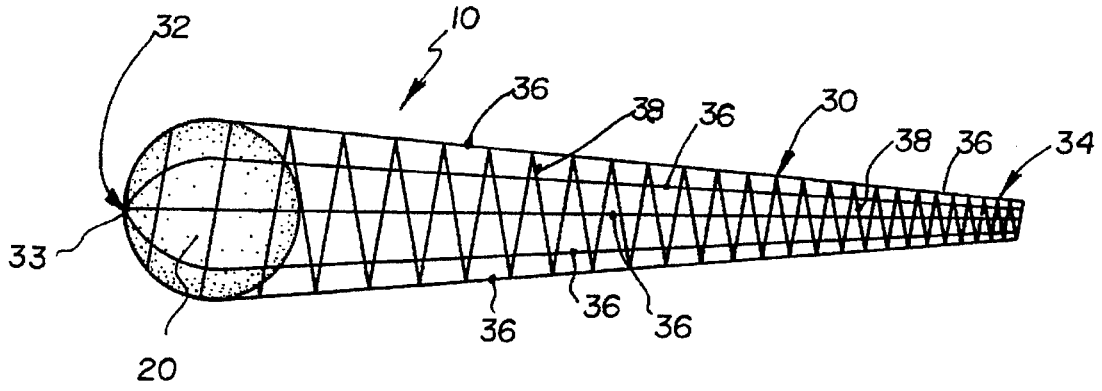
FIG. 1 is a side view of a new Sock Ball Game System displaying the elongated sock enclosure surrounding the ball according to the present invention.

With reference now to the drawings, and in particular to FIGS. 1 through 4 thereof, a new Sock Ball Game System embodying the principles and concepts of the present invention and generally designated by the reference numeral 10 will be described.

More specifically, it will be noted that the Sock Ball Game System 10 comprises a ball 20, and an elongated sock enclosure 30 surrounding the ball 20.

Figure 2:
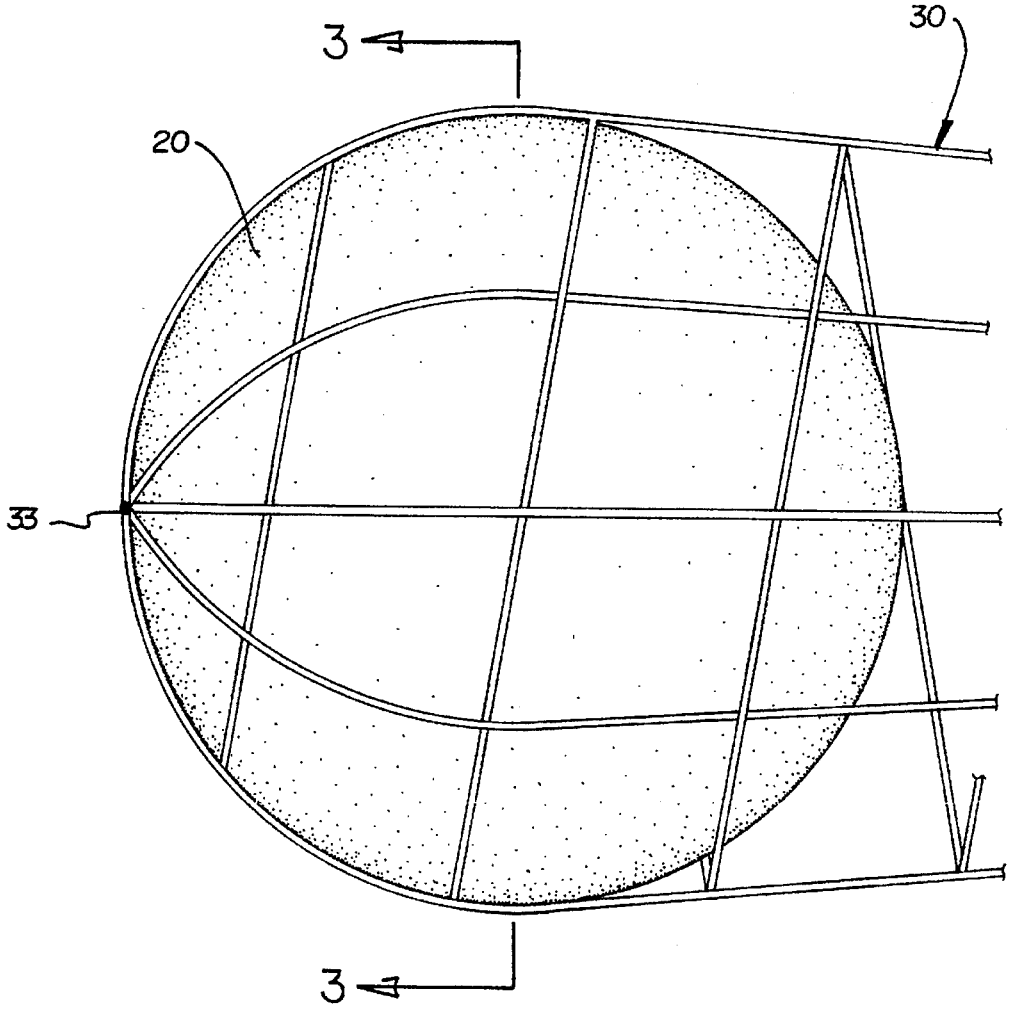
FIG. 2 is a magnified side view of the elongated sock enclosure surrounding the ball.
Figure 3:
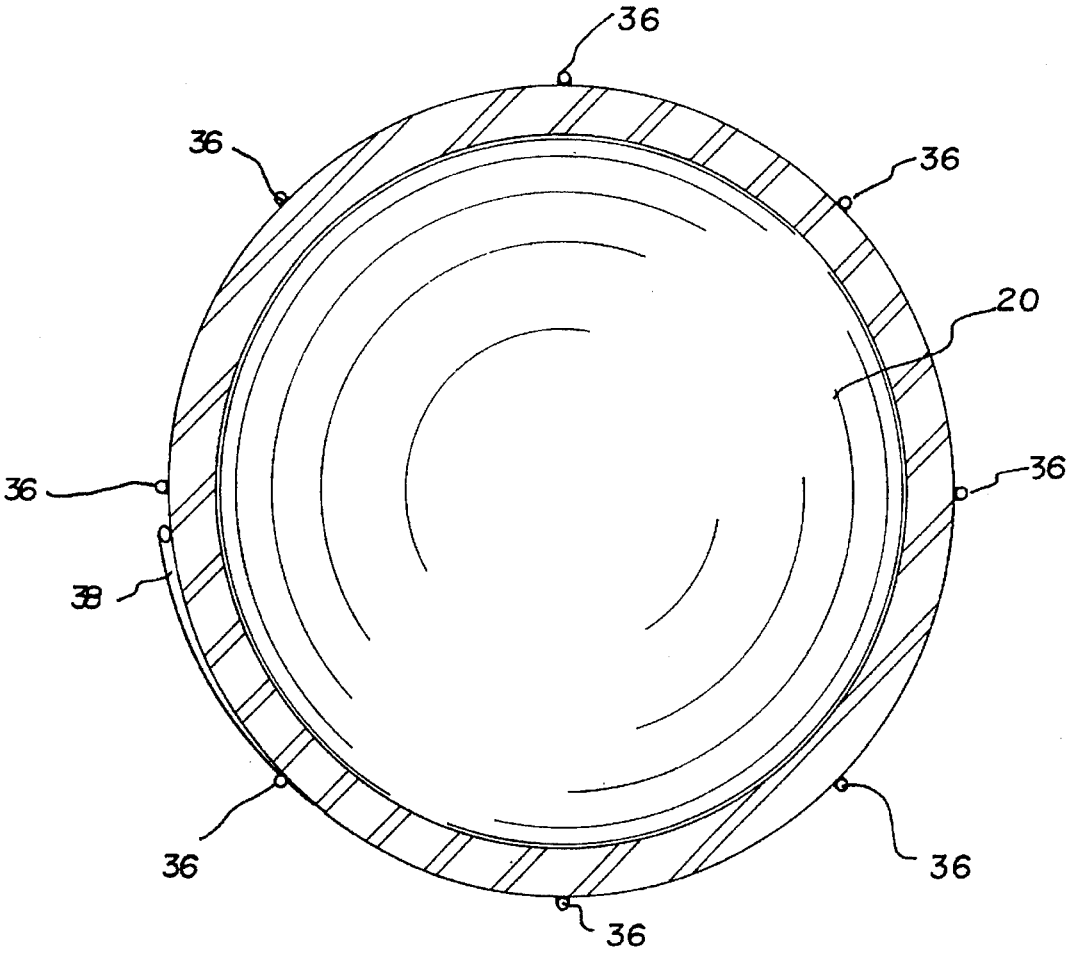
FIG. 3 is a cross sectional view taken along line 3—3 of FIG. 2 displaying the elongated sock enclosure surrounding the ball.

As best illustrated in FIGS. 1 through 3, it can be shown that the elongated sock enclosure 30 includes an enlarged terminal end 32 which houses the ball 20 extending away from the ball 20 ending at a narrow end 34 where the narrow end's 34 diameter is less than the enlarged terminal end's 32 diameter. The elongated sock enclosure 30 includes a plurality of elongated elastic strands 36 extending substantially parallel to each other from a central point 33 on the enlarged terminal end 32 to the narrow end 34 as best shown in FIG. 1 of the drawings. The elongated sock enclosure 30 further includes a spiral elastic strand 38 engaging and projecting from said central point 33 on the enlarged terminal end 32 spirally wound engaging the elongated elastic strands 36 until terminating at the narrow end 34.

Figure 4:
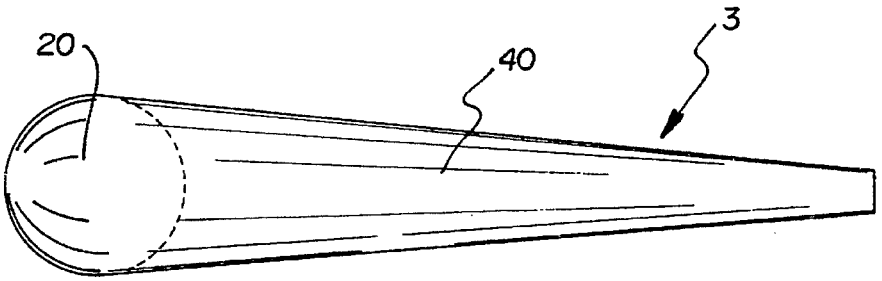
FIG. 4 is a side view of another embodiment of the present invention displaying the solid elastic sock.

In an alternative embodiment as shown in FIG. 4 of the drawings, the elongated sock enclosure 30 includes a solid elastic sock 40 constructed from an unnumbered nonporous elastic material.

In use, the user hits the ball 20 with the elongated sock enclosure 30 surrounding the ball 20 as the user normally would hit the ball 20. While the ball 20 is in flight, the elongated sock enclosure 30 trails behind the ball 20 increasing the visibility to the user and creating drag thereby decreasing the velocity of the ball 20. When the ball 20 engages the unnumbered ground, the elongated sock enclosure 30 substantially prevents the ball 20 from rolling away from the user by creating friction with the unnumbered ground.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A Sock Ball Game System comprising:

a ball;

an elongated sock enclosure surrounding the ball;

the elongated sock enclosure includes an enlarged terminal end which houses the ball extending away from the ball terminating at a narrow end, where the narrow end's diameter is less than the enlarged terminal end's diameter;

the elongated sock enclosure includes a plurality of elongated elastic strands extending substantially parallel to each other from a central point on the enlarged terminal end to the narrow end; and the elongated sock enclosure includes a spiral elastic strand engaging and projecting from said central point on the enlarged terminal end spirally wound engaging the elongated elastic strands until terminating at the narrow end.

2. A Sock Ball Game System comprising;

a ball;

an elongated sock enclosure surrounding the ball;

the elongated sock enclosure includes an enlarged terminal end which houses the ball extending away from the ball terminating at a narrow end, where the narrow end's diameter is less than the enlarged terminal end's diameter;

the elongated sock enclosure includes a solid elastic sock constructed from a nonporous elastic material.

* * * * *